US005307666A

United States Patent [19]

Bianchi

[11] Patent Number: 5,307,666

[45] Date of Patent: May 3, 1994

[54] TRANSFER SYSTEM

[75] Inventor: Sabatino A. Bianchi, Bloomfield Hills, Mich.

[73] Assignee: Livernois Automation Company, Dearborn, Mich.

[21] Appl. No.: 994,365

[22] Filed: Dec. 21, 1992

[51] Int. Cl.[5] ..... B21D 43/05

[52] U.S. Cl. ..... 72/405

[58] Field of Search ..... 72/405, 421; 198/621, 198/774.3

[56] References Cited

U.S. PATENT DOCUMENTS

| | | | |
|---|---|---|---|
| 3,165,192 | 1/1965 | Wallis . | |
| 3,411,636 | 11/1968 | Wallis . | |
| 4,032,018 | 6/1977 | Wallis . | |
| 4,198,845 | 4/1980 | Sofy | 72/421 |
| 5,136,874 | 8/1992 | Fisch | 72/405 |

OTHER PUBLICATIONS

1991 Bernard J. Wallis "Transfer Die Technology" (a six part series reprinted from Modern Medicine Shop Magazine), Livernois Automation Co., Dearborn, Michigan, Copyright, 1991.

*Primary Examiner*—Daniel C. Crane
*Attorney, Agent, or Firm*—Barnes, Kisselle, Raisch Choate, Whittemore & Hulbert

[57] ABSTRACT

A transfer device for indexing workpieces through successive stations of a die in a stamping press is provided wherein the carriage and work engaging fingers are driven through separate drives actuated by the press ram. Each drive has an output shaft for operating the carriage and work engaging fingers, respectively. Each drive is compact and saves space by utilizing a plurality of links to drive the output shaft through 180° of rotation so that desired accelertion and decelaration can be achieved. Each drive is a stand-alone mechanism adapted for use with existing transfer devices.

27 Claims, 16 Drawing Sheets

4
44
35
36
38
39
52
41
37
39c
39b
39d
39a
40b
40
40c
40d
40a
66
64
55
65
62
64a
50
58
48
42
52
56
54
43
10
4

TRANSFER SYSTEM

This invention relates to transfer mechanisms and more specifically to a transfer device for progressively indexing workpieces between stations of a die mounted in a device.

BACKGROUND OF THE INVENTION

A transfer device comprises a base on which a workpiece carriage is slidably mounted for movement to successive work stations. The carriage in turn supports workpiece gripping fingers. Such transfer devices are disclosed, for example, in U.S. Pat. Nos. 3,165,192; 3,411,636 and 4,032,081. Such transfer devices are operated by the ram of a press through an actuator mounted on the carriage for reciprocation along a path parallel to the path of travel of the carriage on the base. The ram drives the actuator and further drives both the carriage and the workpiece engaging fingers through numerous gears. During travel of the actuator, the workpiece engaging fingers are moved inward or outward to engage or disengage a workpiece, depending upon the direction of travel of the actuator, and thereafter, the carriage is shifted on the base laterally with respect to the finger movement through a stroke corresponding to the distance between successive stations.

Such prior transfer devices incorporate a cam and/or a rack and pinion to drive an output shaft to actuate the carriage and work engaging fingers. With prior cam driven transfer devices, only 90° rotation of the output shaft was possible to drive the carriage and the work engaging fingers. As a result, the work engaging fingers, for example, start moving at a slow acceleration and end movement at the highest velocity resulting in high impact forces between the fingers and the workpieces. This produces wear of parts and subjects the device to shock with the possibility of damage. Rack and pinion drives allow 180° shaft rotation resulting in carriage and finger motion starting at a slow acceleration and decelerating at the end of movement to avoid backlash and high inertial forces. However, in order to achieve the 180° rotation, the rack must be excessively long requiring much space and, for example, interferes with changing of the die.

It is therefore a general object of the invention to provide a drive for each a carriage and for work engaging fingers that achieves optimum acceleration and deceleration through its range of motion to avoid damage caused by backlash and high inertial forces, that is an independent stand-alone assembly adapted for use with existing transfer devices, and that is compact and saves space.

SUMMARY OF THE INVENTION

The foregoing and other objects are obtained in accordance with the present invention in which the carriage and work engaging fingers are driven by separate drives actuated by a press ram. Each drive is compact and saves space by using a pluarality of interconnecting links to reciprocate the carriage and work engaging fingers and to achieve desired accelaration and deceleration. The drives comprise a housing having cam plates and a first link member that is driven at one end by the press ram to reciprocate therein. The other end of the first link member has a follower received in a slot at one end of a second link member. In the finger drive, the second link member has first and second cam followers.

The first cam follower engages an outer cam surface of the cam plates while the second cam followers are received within cam slots in the cam plates. In the transfer drive, the second link member only has first cam followers received in a cam slot in the cam plates. The second link member of both drives has a bifurcated end that connects to a third link member that connects to an output shaft through a crankshaft. The output shaft of each drive is connected to the fingers and carriage, respectively, through a slotted drive plate. As the press ram reciprocates, the first link member reciprocates therewith to actuate the second and third link members, the crankshaft and thus the output shaft to drive the work engaging fingers and carriage, respectively.

The relationship between the cam plates and cam followers on the second link member allows the output shaft to be rotated a full 180°. The output shaft slowly accelerates at the beginning of rotation and decelerates at the end of rotation. Thus, both the fingers and the carriage are driven through the slotted drive plates by the output shaft to be slowly accelerated at the beginning of movement and decelerated at the end of movement.

The arrangement of the link members within the housing allows for 180° rotation of the output shaft while being compact to save space.

In a preferred embodiment, the slot in the second link member is substantially S-shaped thus shortening the length of the second link member to provide even more compactness.

IN THE DRAWINGS

FIG. 1 is a plan view of a transfer device according to the present invention.

FIG. 2. is a view taken along line 2—2 of FIG. 1;

FIG. 4 is a sectional view taken along line 4—4 of

Figure 5:
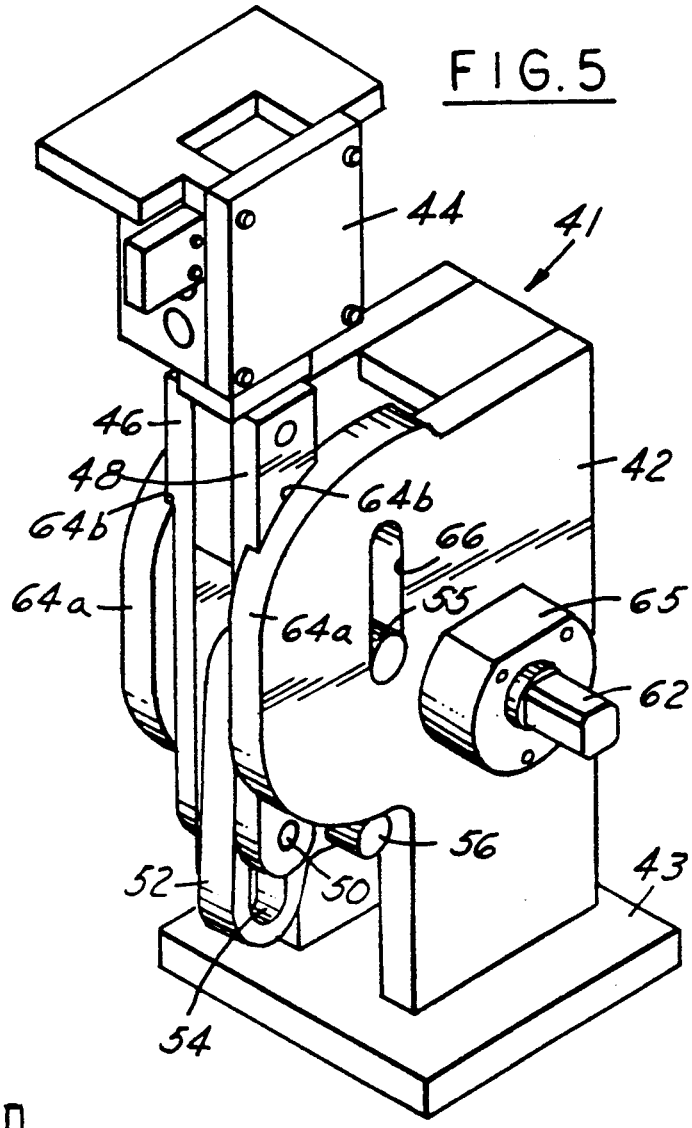
Figure 6:
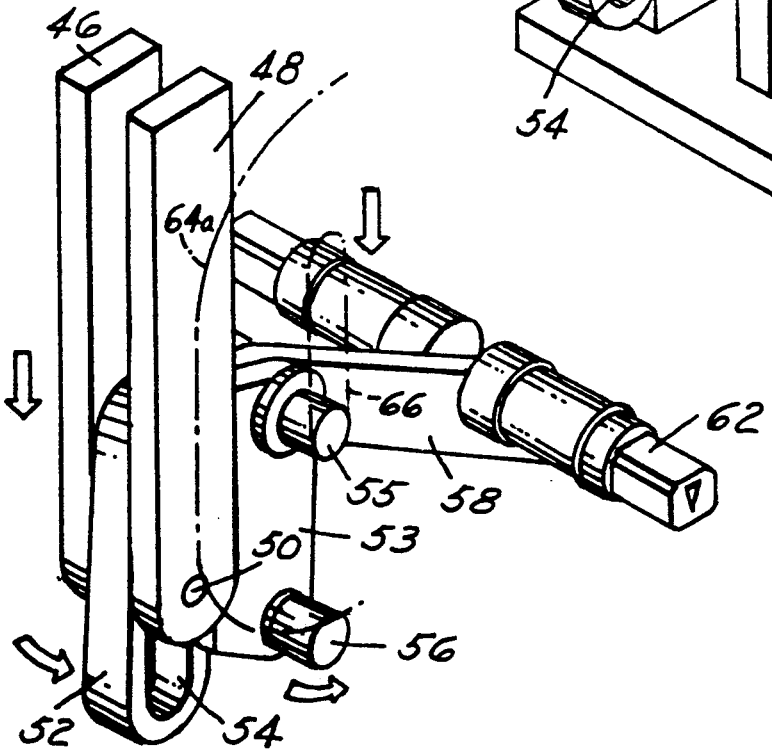
Figure 7:
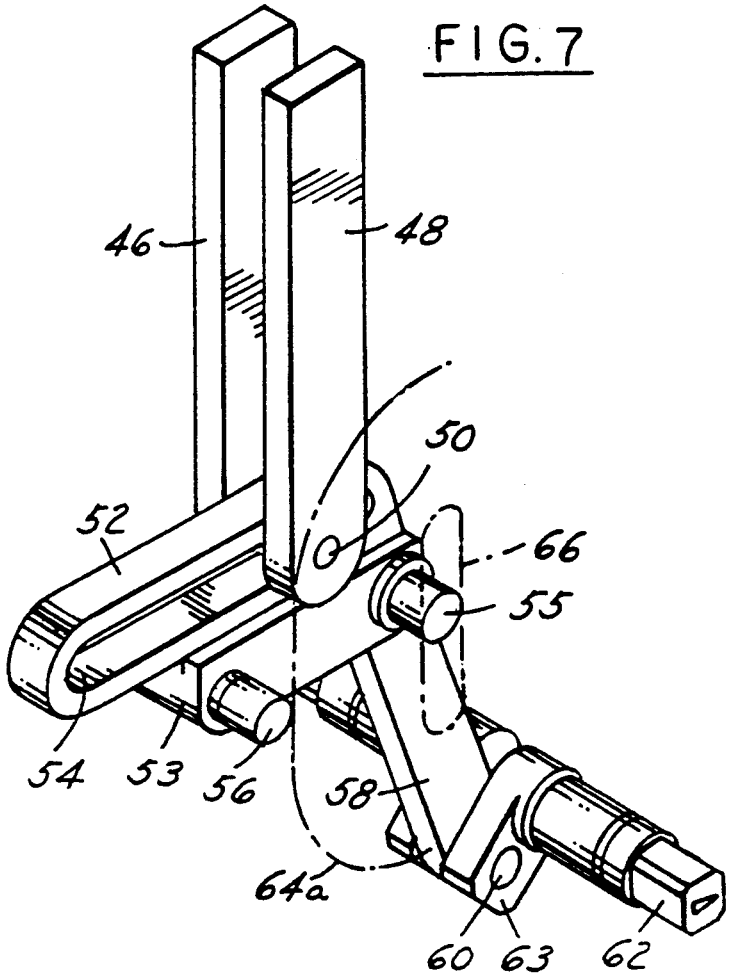
Figure 8:
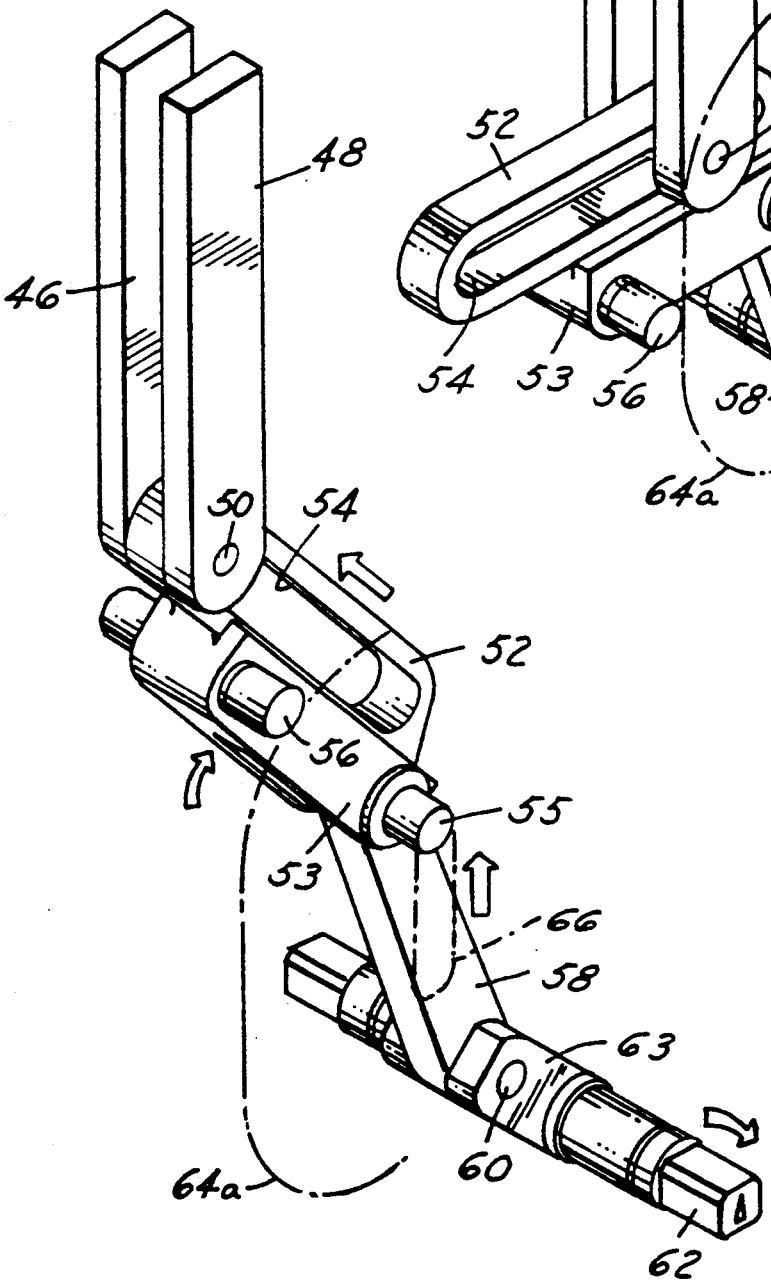
Figure 9:
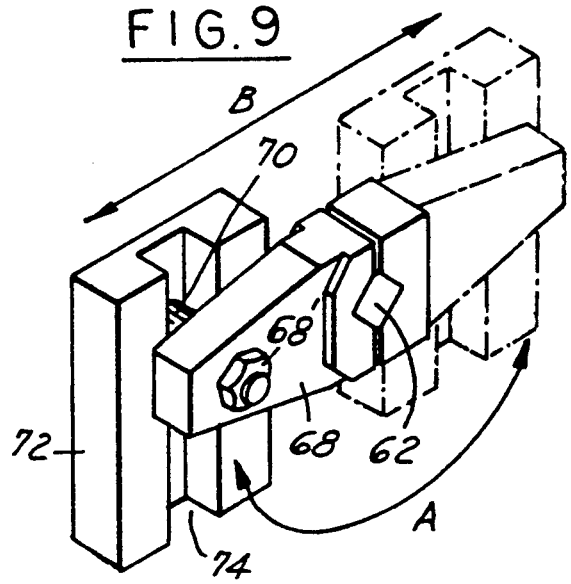
Figure 12:
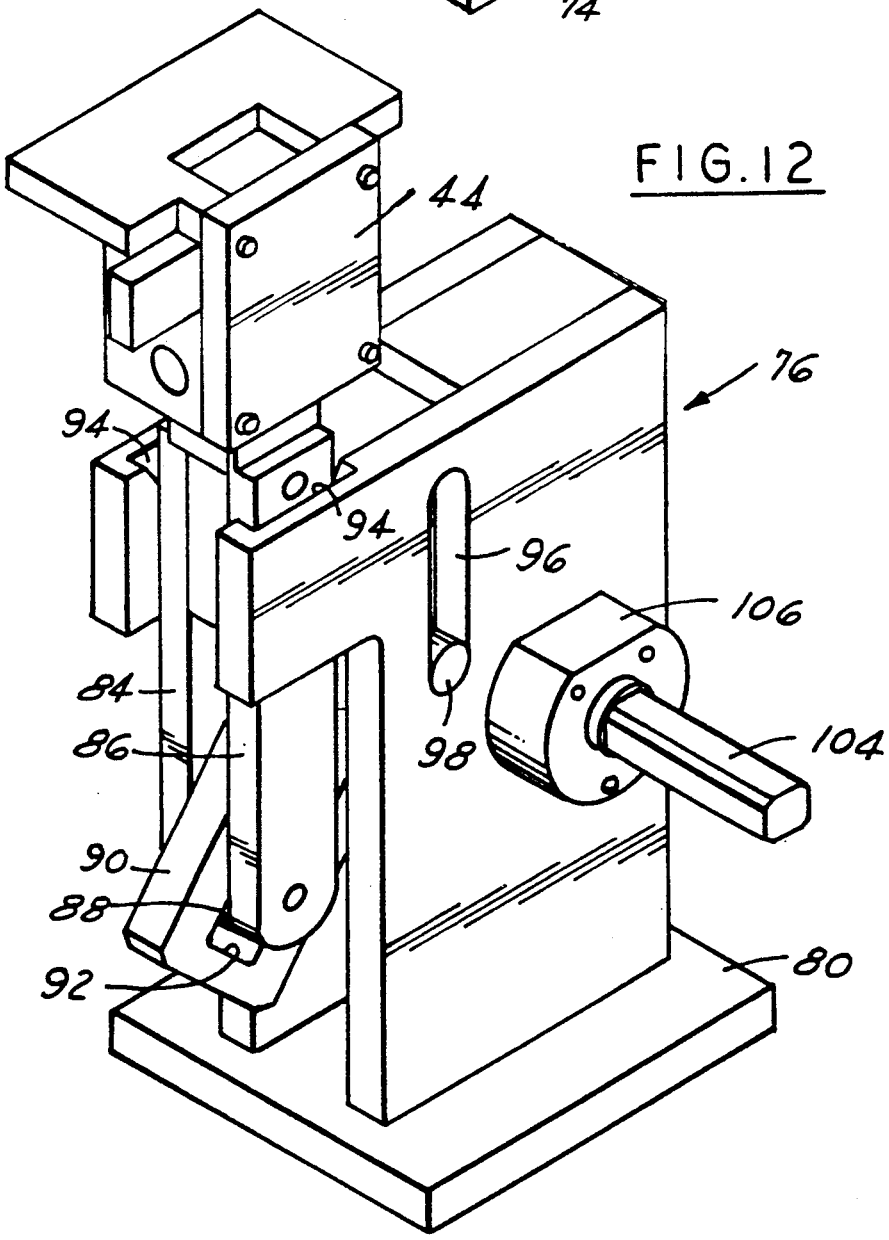
Figure 10:
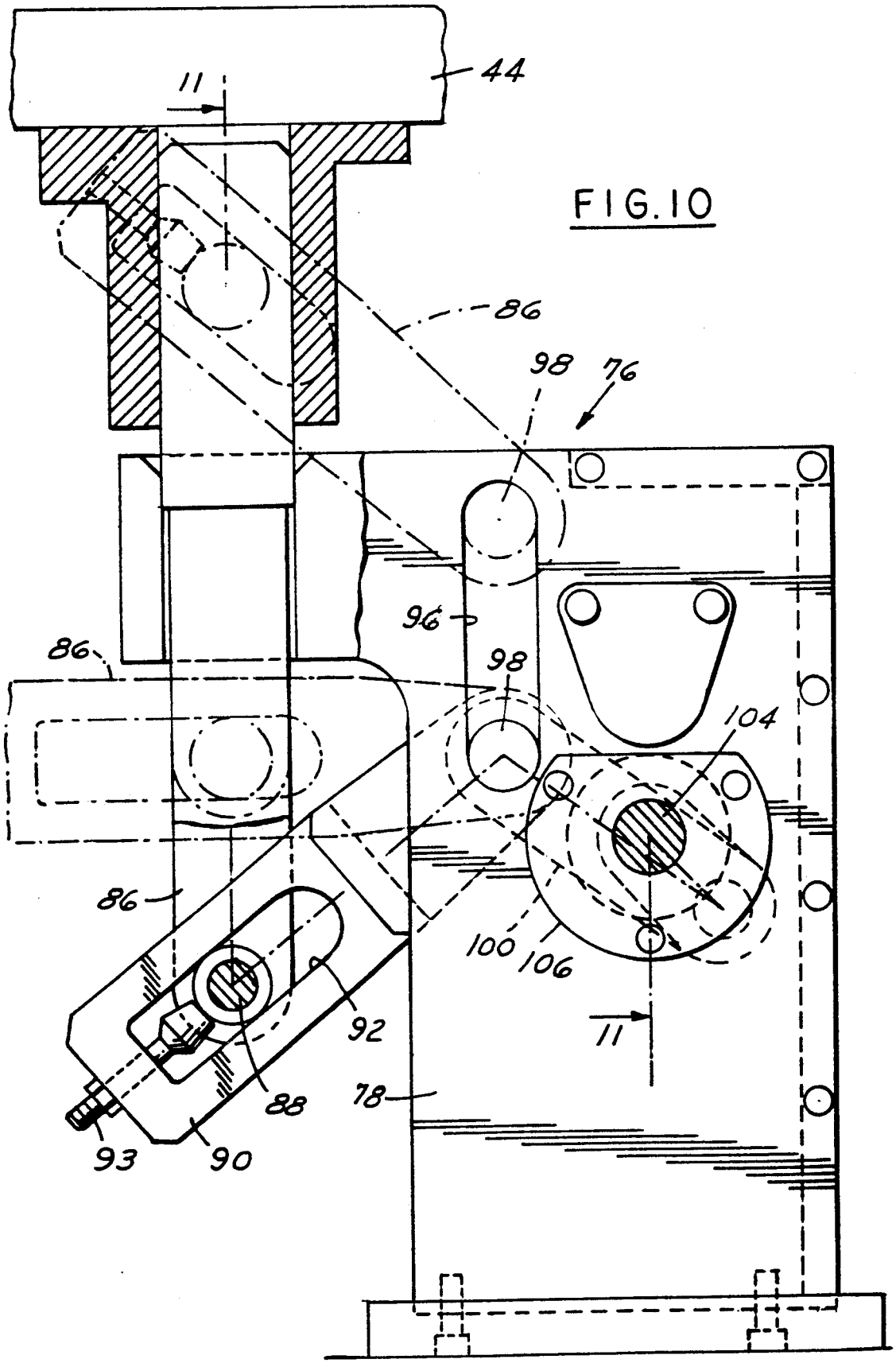
Figure 11:
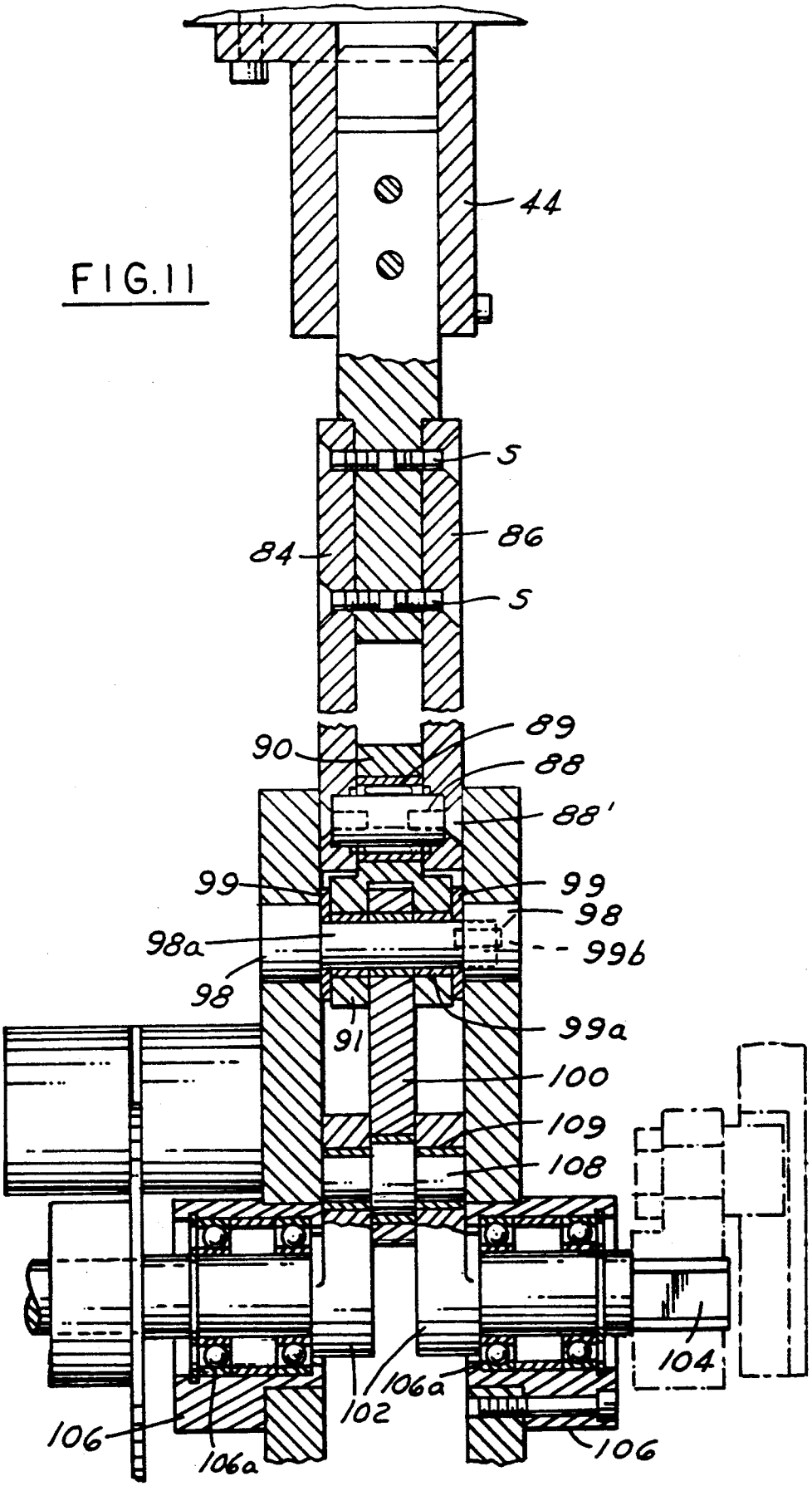
Figure 13:
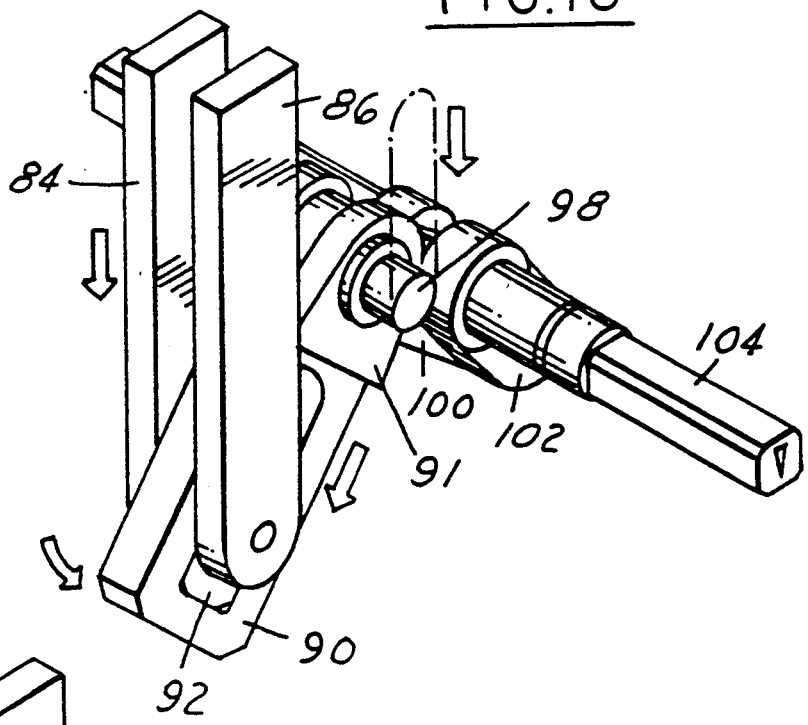
Figure 14:
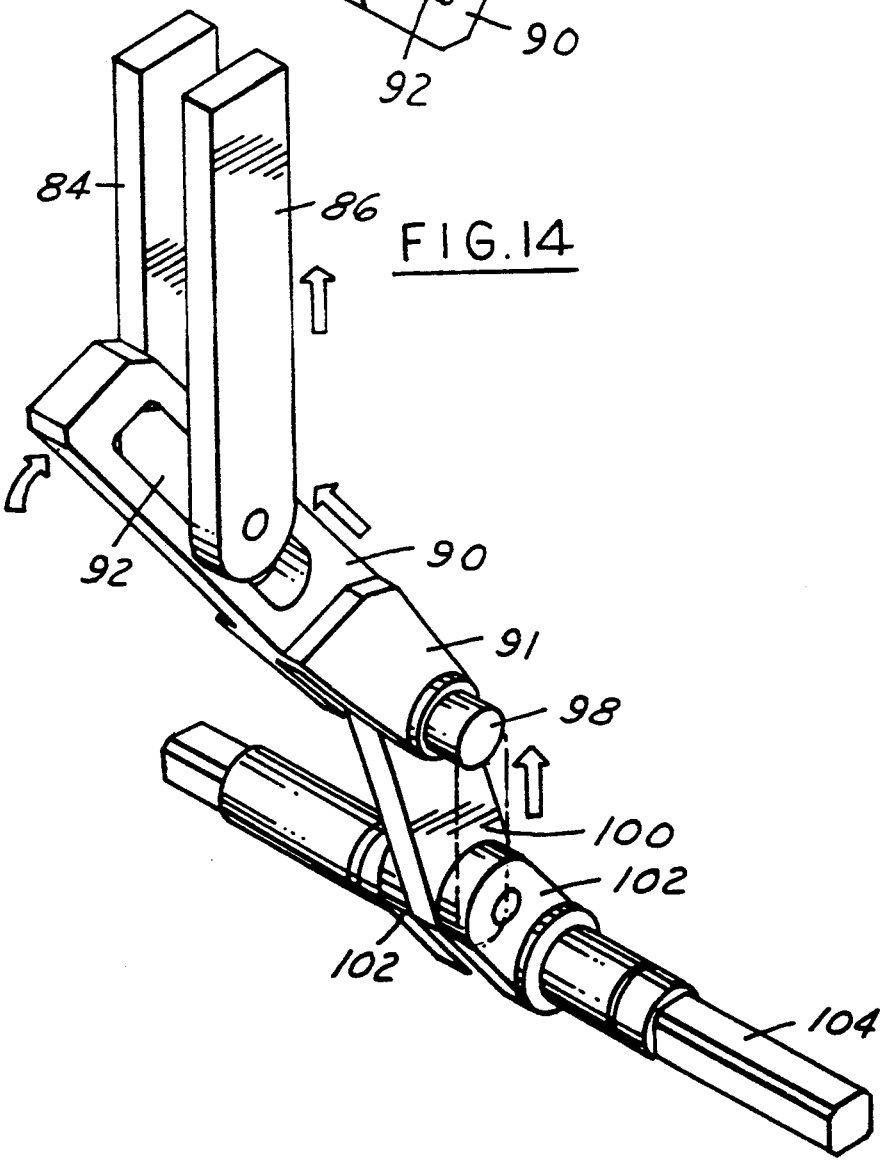
Figure 15:
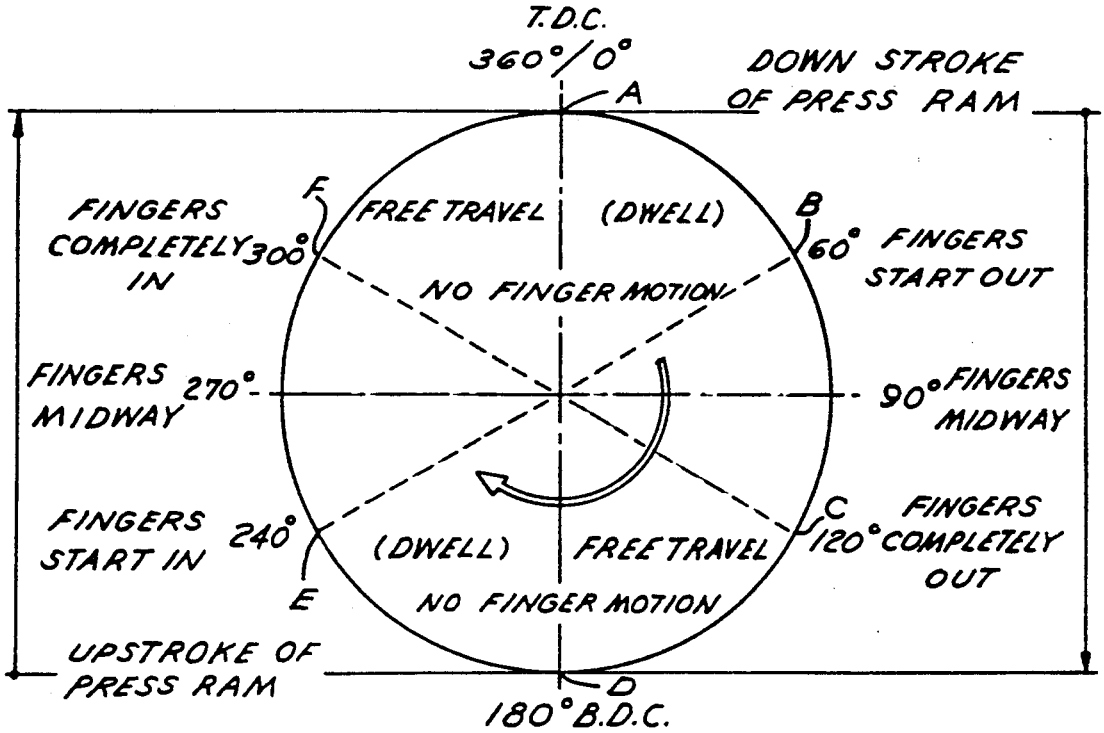
Figure 16:
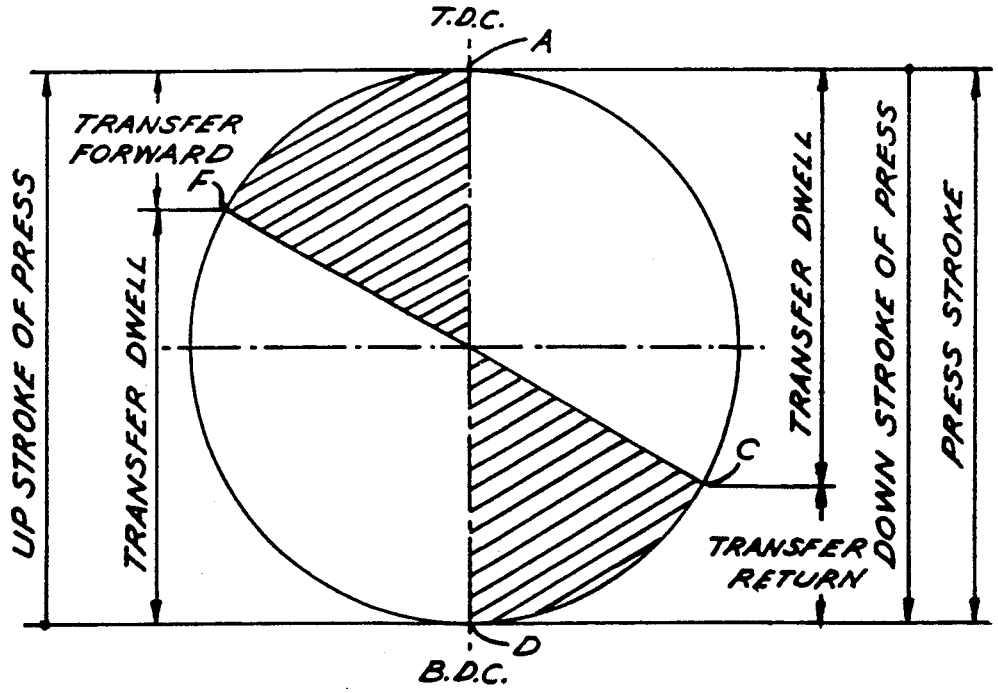
Figure 17:
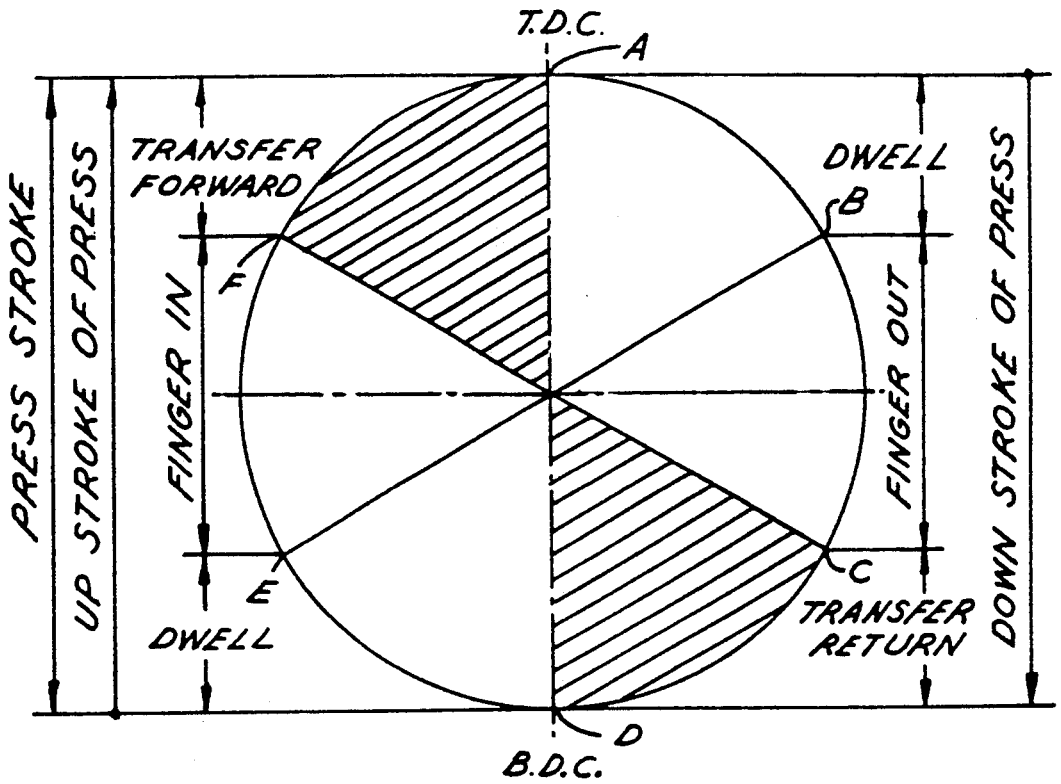
Figure 18:
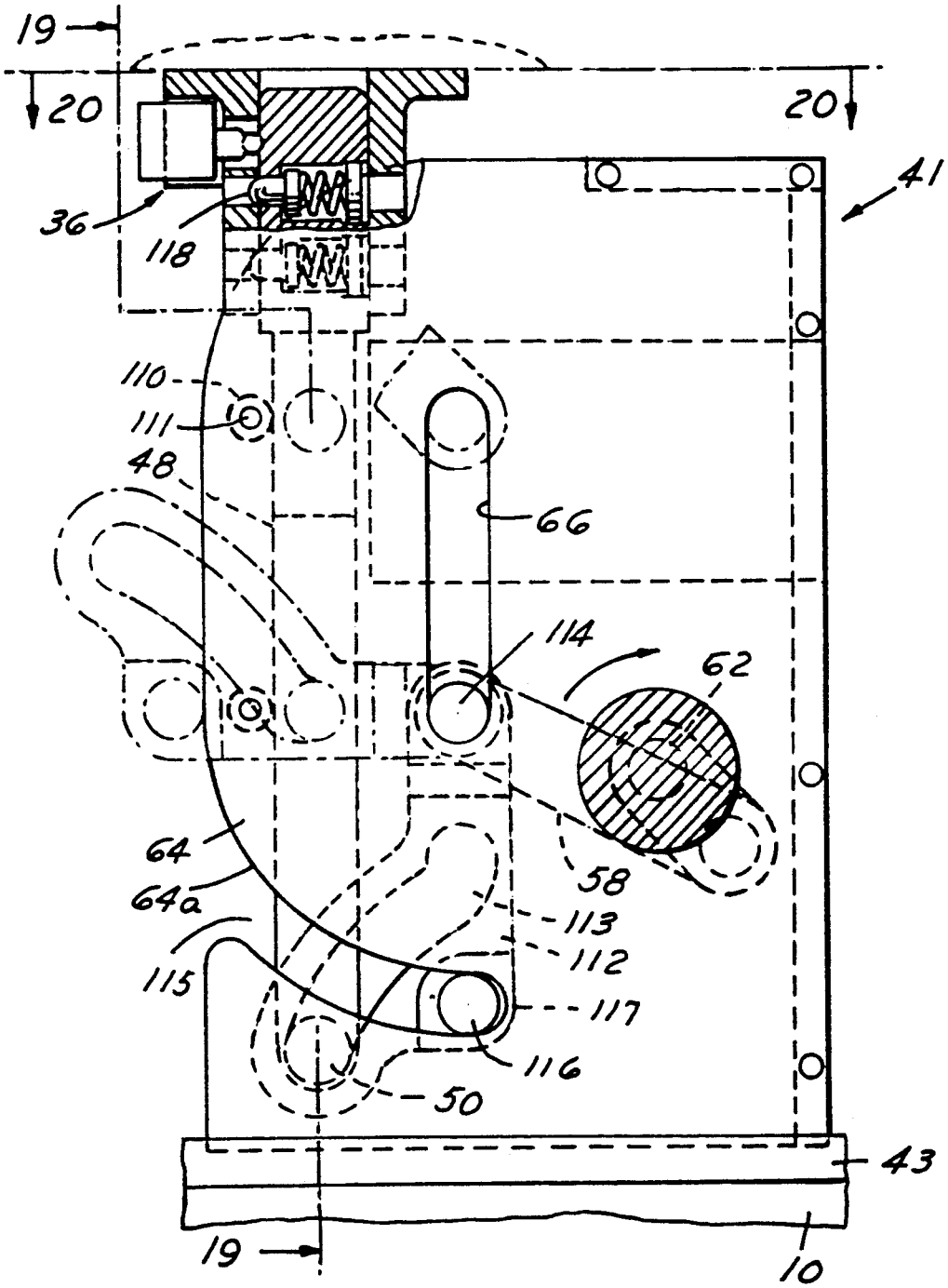
Figure 19:
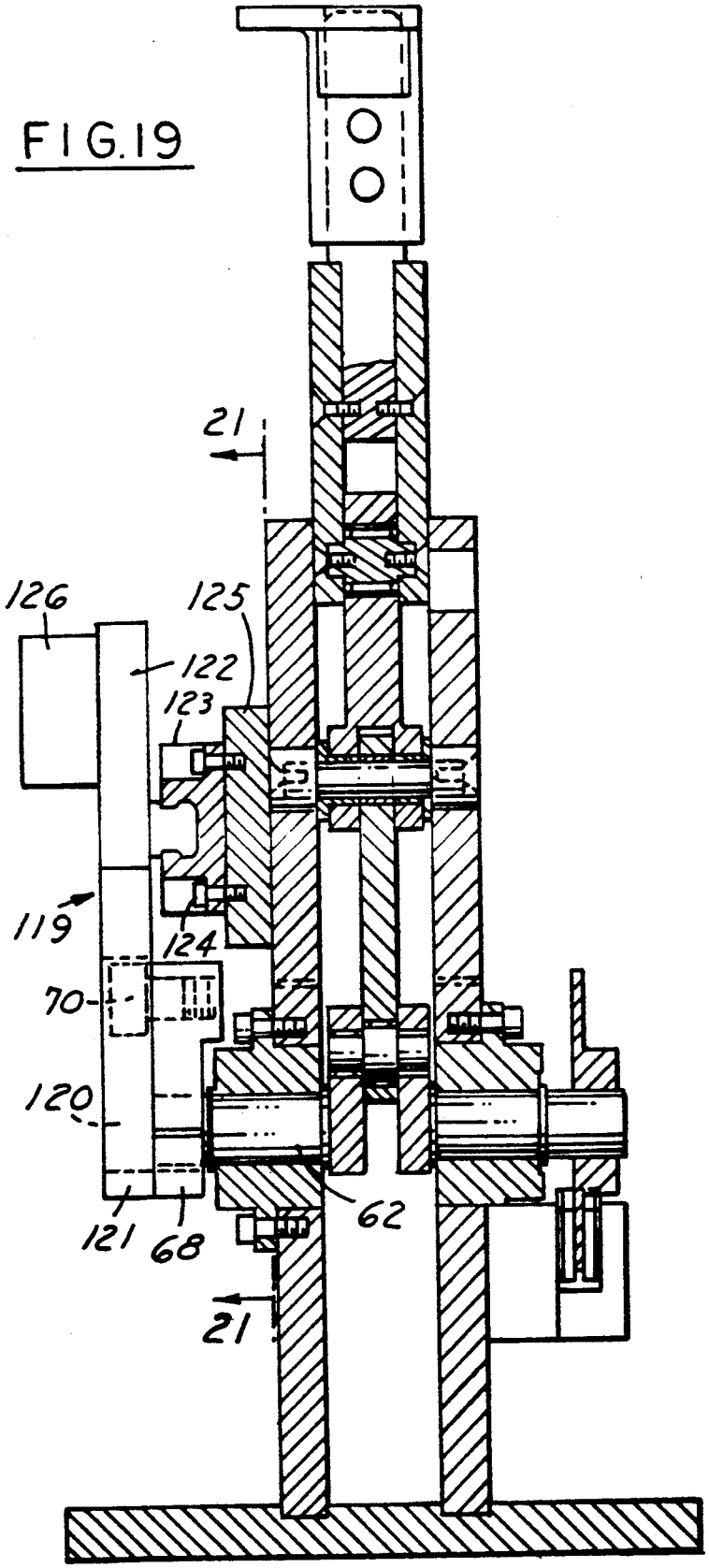
Figure 20:
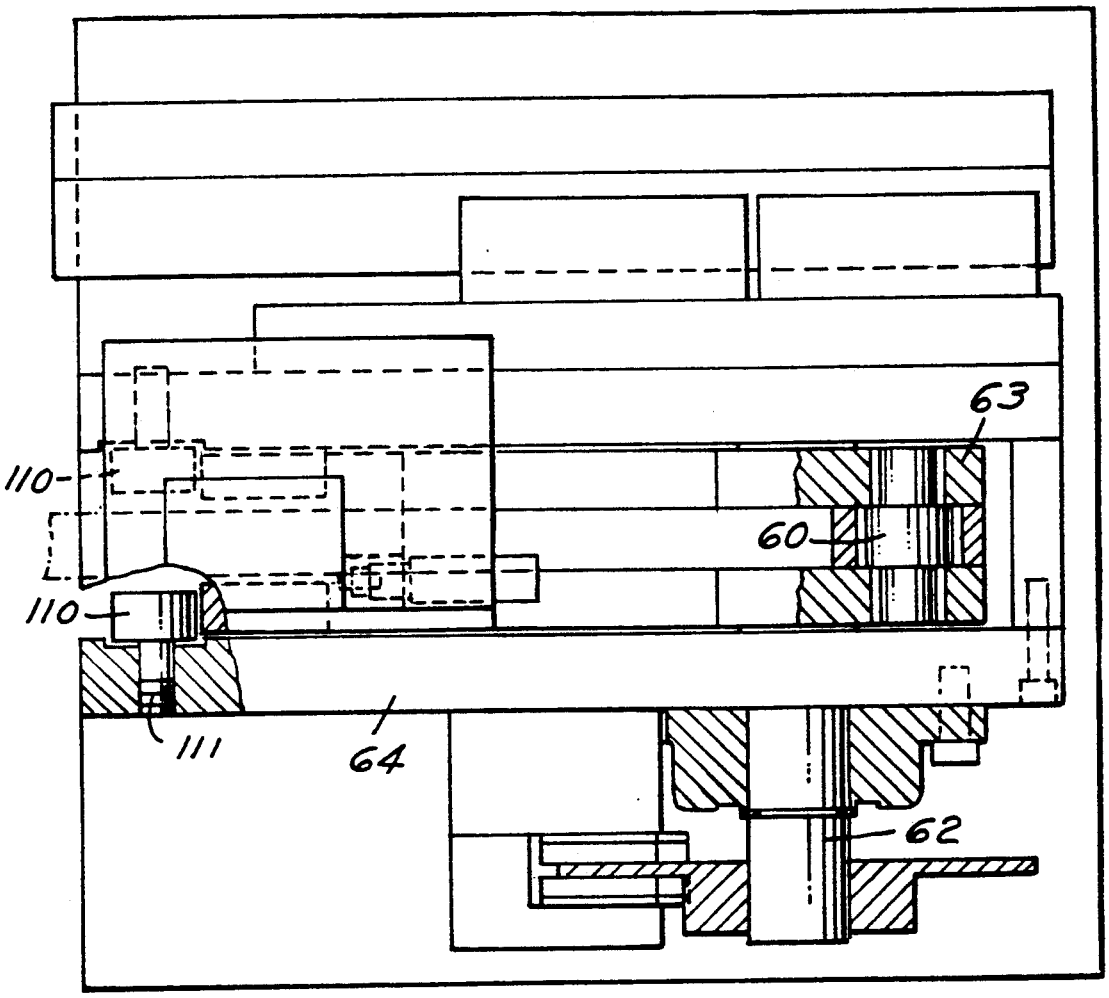

FIG. 5 :s a perspective view of the finger drive with the ram at the bottom of its stroke;

FIG. 6 is a cutaway view of the finger drive when the ram is at the bottom of the press stroke;

FIG. 7 is a cutaway view of the finger drive when the ram is in midstroke;

FIG. 8 is a cutaway view of the finger drive when the ram is in the top of the press stroke;

FIG. 9 is a perspective view of the output crank arm;

FIG. 10 is a side view of the transfer drive;

FIG. 11 is a sectional view taken along line 11—11 of FIG. 10;

FIG. 12 is a perspective view of the transfer drive;

FIG. 13 is a cutaway view of the transfer drive when the ram is at the bottom of the press stroke;

FIG. 14 is a cutaway view of the transfer drive when the ram is at the top of the press stroke;

FIG. 15 is a diagram showing the timing of the finger drive;

FIG. 16 is a diagram showing the timing of the transfer drive;

FIG. 17 is a diagram showing the combination FIGS. 15 and 16;

FIG. 18 is a side view of a preferred form of the finger drive;

FIG. 19 is a view through line 19—19 of FIG. 18;

FIG. 20 is a view through line 20—20 of FIG. 18; and

Figure 21:
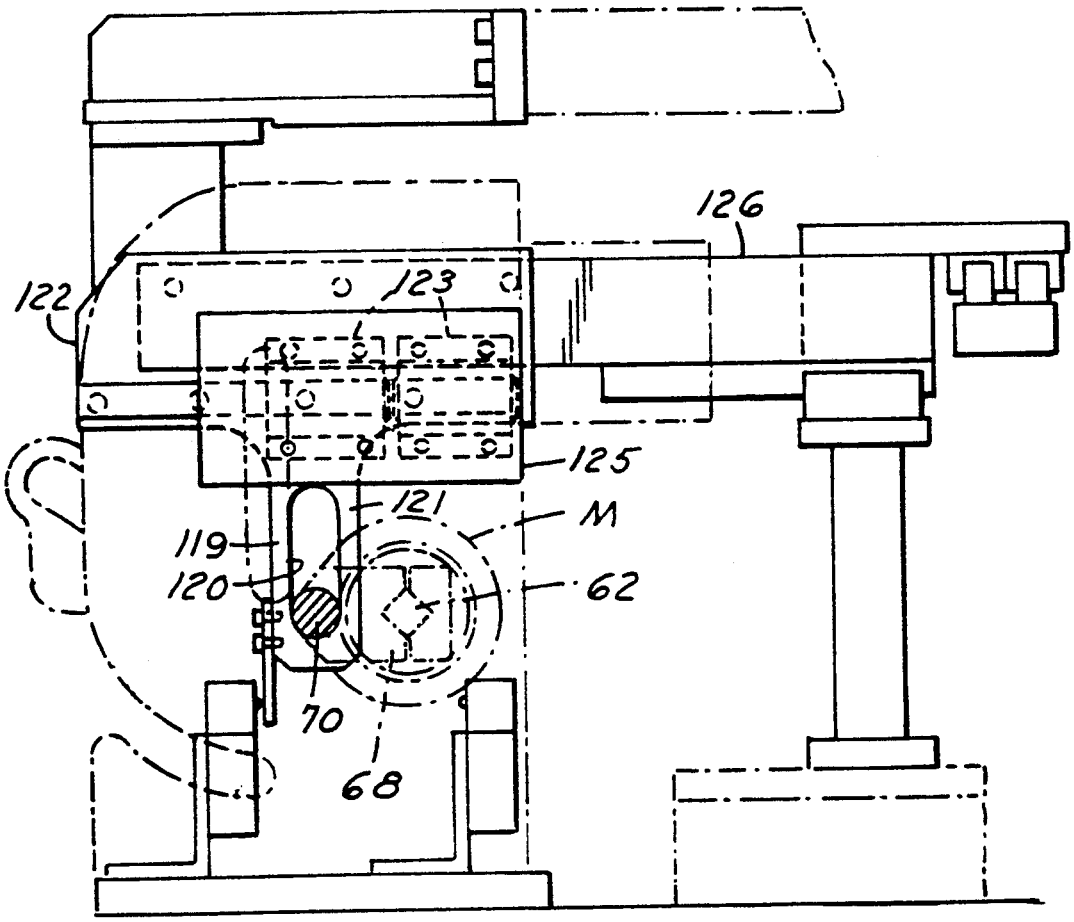

FIG. 21 is a view through line 21—21 of FIG. 19.

DESCRIPTION

Figure 1:
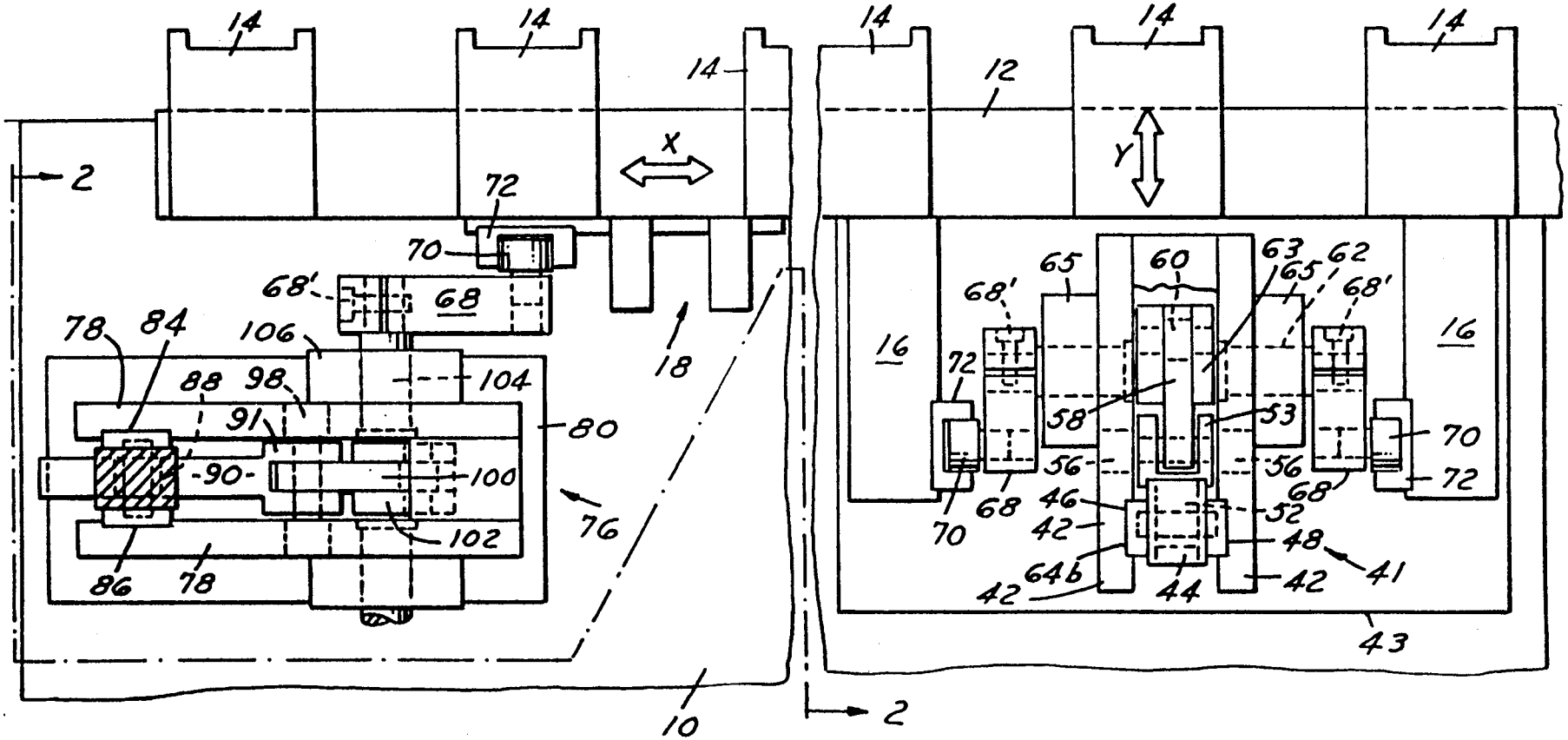
Figure 2:
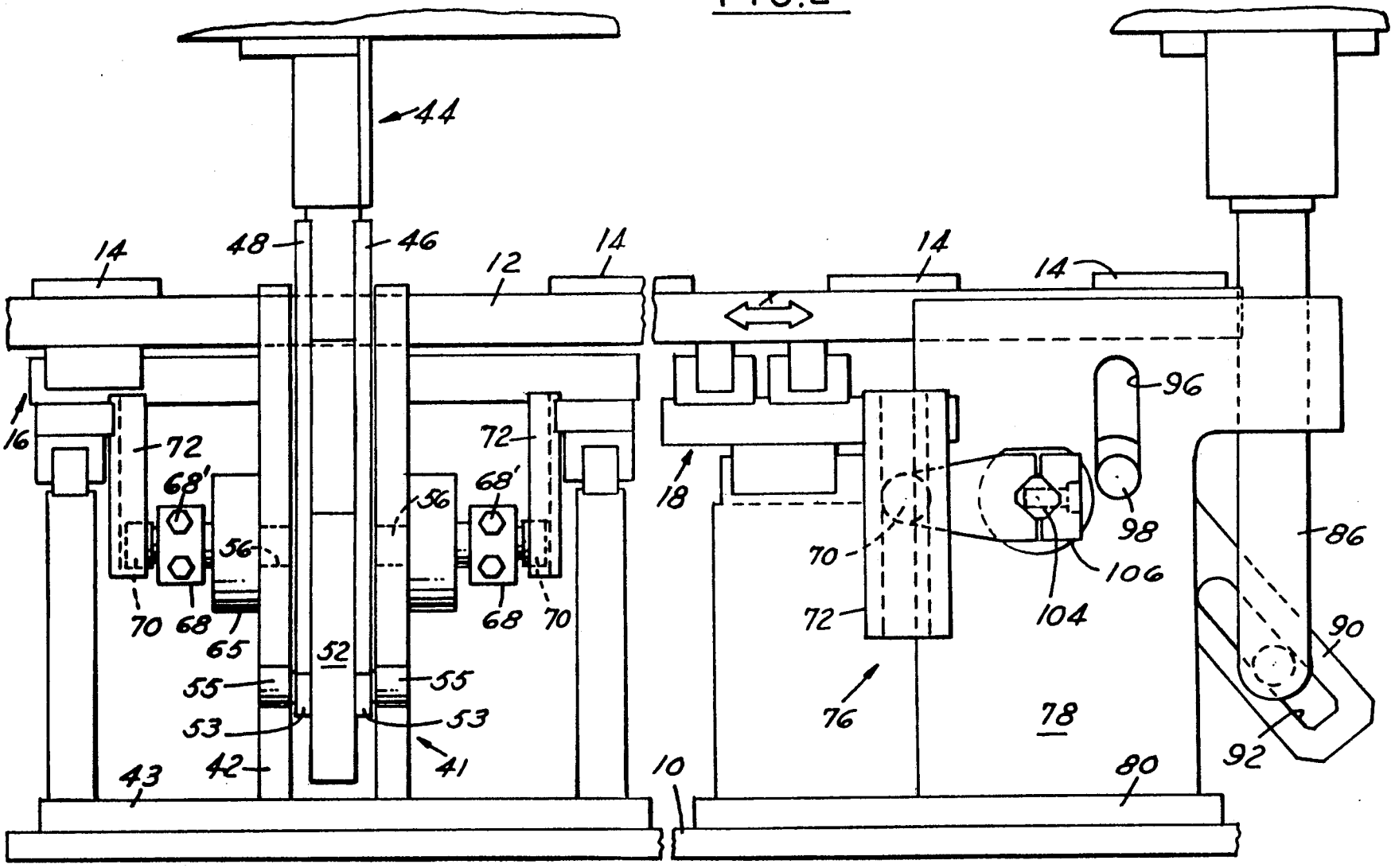
Figure 3:
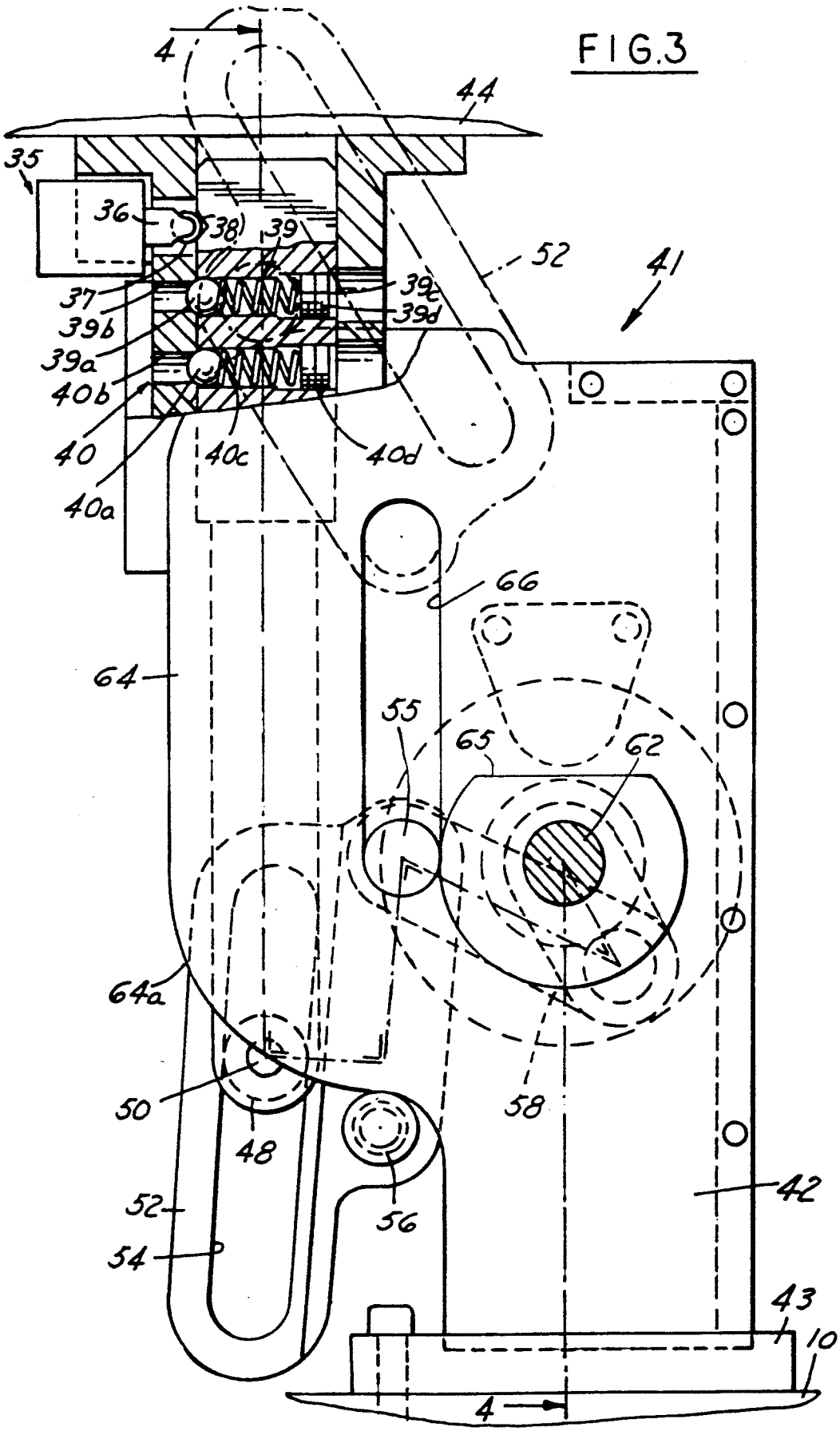
FIG. 3 is a side view with a partial cutaway section of the finger drive according to the present invention.
Figure 4:
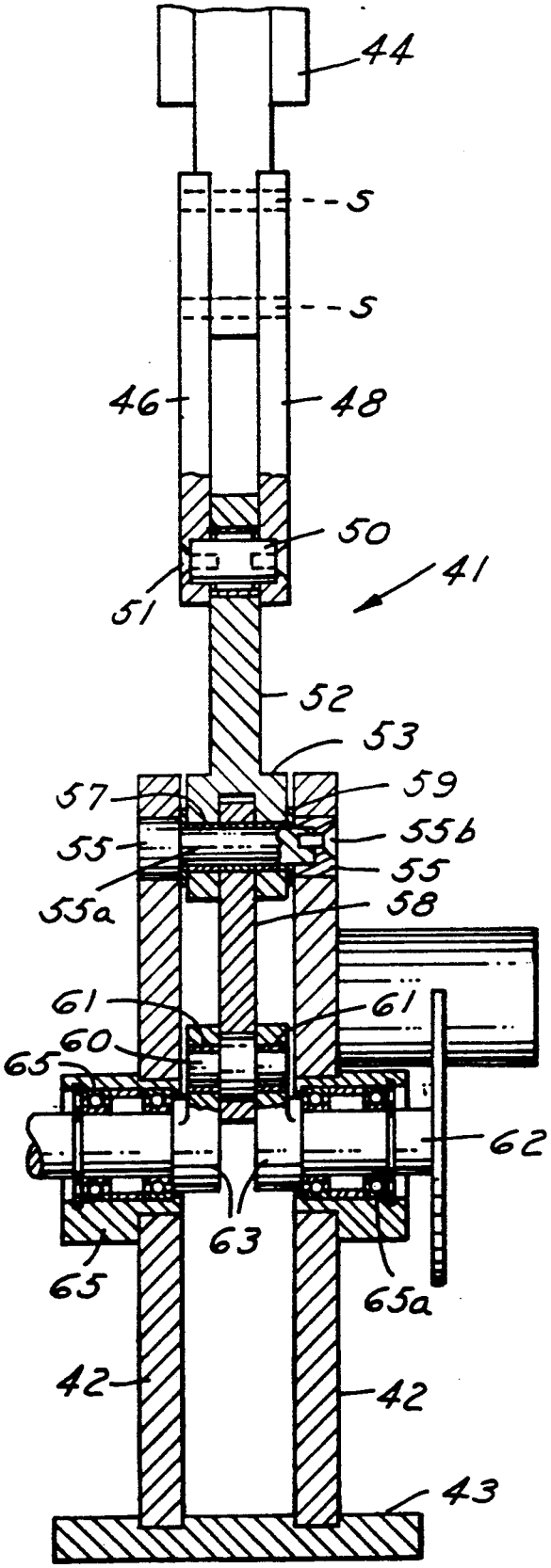

In the arrangement shown in FIGS. 1 and 2, the transfer device includes a base 10 upon which carriage 12 (shown schematically) is mounted. The carriage 12 is driven and reciprocates along an axis represented by arrow X by a transfer drive mechanism 76. The carriage 12 includes a plurality of work engaging fingers 14 driven along an axis represented by arrow Y by finger drive mechanism 41. FIGS. 1 and 2 show only half of the entire transfer device, it being understood that identical carriage and finger structure is located opposite that shown with only an identical finger drive. Thus, the one transfer drive 76 operates to shift the entire carriage through its transfer stroke while a finger drive 41 is required on each side of the transfer device to shift the work engaging fingers 14 toward and away from each other. The arrangement of the carriage and work engaging fingers shown and described so far is conventional and is of the type disclosed in, for example, U.S. Pat. No. 4,032,018. In such devices, a drive mechanism is employed that is timed in relationship to the vertical movement of the press ram such that when the ram is traveling upwardly, the work engaging fingers 14 are shifted toward each other to grip workpieces (not shown) and the carriage 12 is thereafter shifted transverse to the finger movement to advance the workpieces to the next successive die station. Normally, the step of advancing the workpieces occurs while the press ram is traveling through top dead center. In the downstroke of the press ram, the work engaging fingers 12 are retracted to a position clearing the punches on the ram and while the punches are forming the workpieces, the carriage 12 is retracted to its starting position.

The present invention is primarily concerned with providing two separate drives both operable by the press ram. One drive is a finger drive 41 for driving the work engaging fingers and the other drive is a transfer drive 76 for reciprocating the carriage.

Referring particularly to FIGS. 3-8, the finger drive 41 is shown. The drive 41 is composed of a housing 42 which rests upon a base 43. The housing 42 comprises cam plates 64 on each side thereof. A first link 45 comprises parallel links 46, 48 and is fixedly connected by securing means S to the ram 44 at one end. The ram 44 is driven by means (not shown) in a reciprocal motion to reciprocate the first link 45 therewith. The parallel links 46, 48 are received in and guided by guide slots **64*b* (FIG. 5) inside of cam plates 64 for reciprocal movement. The ends of the parallel links 46, 48 opposite the ram have a rotatable follower 50 interconnecting therebetween by securing means 51. The follower 50 is received in an elongated slot 54 in a second link 52 for guided movement therealong. The second link 52 has a first and second set of cam followers 55, 56. The first set of cam followers 55 are received and travel within elongated cam slots 66 in the cam plates 64. The second set of cam followers 56 are positioned to engage along an outer cam surface 64*a* on the cam plates 64. The cam followers 55, 56 are rotatably mounted on a shaft, for example, 55*a* (FIG. 4) by any means such as a screw seen at 55*b*. The shaft 55*a* extends through a bifurcated end 53 of the second link 52 and has a bearing 57 for pivotal connection therewith. The bifurcated end 53 connects one end of a third link 58 by the shaft 55*a*. The opposite end of the third link 58 is connected to a crank shaft 63 coupled to the output shaft 62. A connector 60 and bearing 61 mount the end of the third link 58 for pivotal movement to the crankshaft 63. The output shaft 62 is rotatably mounted within a bearing housing 65 by roller bearings 65*a***.

An overload mechanism 35 (FIG. 2) is provided comprising an arm 36 with a roller 37 that engages a notch 38 in the upper portion of the parallel links 46, 48. Spring loaded balls 39, 40 hold the links 46, 48 to the ram 44 by engagement with openings **39*b*, 40*b*. The springs 39*c*, 40*c* bias the balls into engagement with the ram and are retained by a threaded member 39*d*, 40*d* which may be adjusted to change the spring force. Upon an overload condition, the force of the ram overcomes the spring force to move the balls 39, 40 out of engagement with the openings 39*b*, 40*b*. Thus, the ram 44 travels downward relative to links 46, 48. Arm 36 is then forced out of notch 38 and forced to the left as viewed in FIG. 2** to shut off the ram electrically; however, the ram continues to move approximately one-third of an inch by gravity to completely withdraw the fingers.

Referring now particularly to FIGS. 6-8 and 15, movement of the finger drive will now be described. When the ram is at the bottom of the press stroke, the finger drive is in the position shown in FIG. 5 where second link 52 is pivoted to the down position with the first cam followers 55 being positioned at the bottom of the cam slots 66 and second cam followers 56 being at the bottom of cam plates 64. As the ram 44 moves upward, the second cam followers 56 of the second link 52 follow along cam surfaces **64*a* as the second link 52 pivots about first cam followers 55. Output shaft 62 does not rotate thus there is a free travel of the ram 44 and the parallel links 46, 48. This free travel continues until the second cam followers 56 reach a point on the cam surfaces 64*a* where the first cam followers 55 begin movement of travel within cam slots 66. As the ram 44 continues its upward movement to the midstroke position as shown in FIG. 7, the parallel links 46, 48 are further raised. The follower 50 engages the end of the slot 54 in second link 52 thus raising the second link 52. First cam followers 55 move vertically along the cam slot 66. At the same time, second cam followers 55 engage along the cam surfaces 64*a* causing the second link 52 to pivot upwardly to the position shown in FIG. 7. As the second link 52 moves, the third link 58 moves therewith to rotate the crankshaft 63 and thus the output shaft 62 to a position 90° from the position in FIG. 6. Upon further upward movement of the ram, first cam followers 55 are moved further upwardly until they reach the upper end of the cam slot 66 as indicated in FIG. 8. At this point, the output shaft has rotated another 90° to reach the end of its full range of 180° movement starting from the position of FIG. 6 and ending in the position shown in FIG. 8. However, as the ram 44 freely travels to approach its upper press stroke, second cam followers 56 continue to follow along cam surfaces 64*a* thus further pivoting the second link 52 as the follower 50 moves along slot 54. As the ram 44 descends to begin the down stroke, the link movement merely reverses. Thus, there is free travel of the parallel links 46, 48 until first cam followers 55 begin movement in cam slots 66. When the first cam followers 55 again reach the bottom of cam slots 66 (FIG. 6), there is again free travel of the ram 44 and the parallel links 46, 48** until the ram reaches bottom dead center.

It can thus be seen that the output shaft 62 is limited to a 180° reciprocating motion and is only rotating when the first cam followers 55 confined within the cam slots 66 are moving. When the ram is at the mid-stroke position (FIG. 7), the output shaft 62 has rotated 90° from its prior position (FIG. 6). Thus, the output shaft 62 reaches this identical position when the ram is at midstroke regardless of the upward or downward travel of the ram. The fingers, which are connected to the output shaft, are positively controlled to be in on the up stroke of the ram and out on the down stroke. When the first cam followers 55 reach either end of the cam slots 66, the rotation of the output shaft 62 stops. The second cam followers, 56 on the outside of the cam plates 64 will continue to follow the contour of the cam surfaces 64*a*, again allowing for free travel of the ram 46 and the parallel links 46, 48. The free travel is dwell time and occurs during the press stroke both before and after the finger motion.

Referring now to FIG. 9, the output crank arm with a cam follower and a slotted drive plate is shown. This crank arm and drive plate mechanism is of a Scotch-yoke type drive and is used on both the finger drive 41 and the transfer drive 76. This can be seen in FIGS. 1 and 2 where crank arm 68 at finger drive 41 transmits movement to fingers 14 through finger actuator 16 through the drive plate 72. Likewise, crank arm 68 of transfer drive 76 transmits movement to carriage 12 through the drive plate 72 and transfer actuator 18. The crank arm 68 is secured to the output shaft 62 by any means, such as, for example bolt 68'. As the crank arm 68 begins to rotate, it slowly accelerates the drive plate 72 in the horizontal plane in the direction of the arrow B. The crank arm 68 swings from the left position down and to the right to the position shown in phantom. This motion is represented by arrow A. As the crank arm 68 moves, cam follower 70 reciprocates within slot 74 in the drive plate 72 and moves the drive plate 72 from the solid line position to the position shown in phantom. Thus, the drive plate 72 moves horizontally along the direction of arrow B in FIG. 9 and is accelerated and decelerated through the range of motion indicated by arrows A, B. The point of highest acceleration occurs when the crank arm 68 is at mid-position (not shown). The mid-position would be 90° in the direction of arrow A from either the solid line or phantom line position in FIG. 9. As the crank arm 68 passes the mid-position, it begins to decelerate, reaching minimum speed as it approaches the horizontal plane. The action of slow acceleration at the start, maximum speed at mid-position and slowing to a stop at 180° of rotation gives the desired controlled motion of the drive plate 72 and thus to both the carriage 12 and fingers 14 to allow for a more smooth transitional mechanical movement of the device thus reducing the load thereon and the likelihood of damage.

Referring now to FIGS. 10–14, the transfer drive will be described. This drive is very similar to the finger drive described previously in FIGS. 3–8, with the main differences being the slot and cam surface arrangement. As seen in FIG. 12, the transfer mechanism 76 consists of housing 78 which rests upon base 80. The ram 44 is mounted to the parallel links 84, 86 for reciprocal movement. Follower 88 is rotatably mounted in bearings 89 (FIG. 11) connected by securing means 88' at the free end of the parallel links 84, 86 and is captured within slot 92 of second link 90. The second link 90 has a set of cam followers 98 captured within cam slots 96 in the housing 78. The cam followers 98 are secured to a shaft 98*a* by means such as a screw 99*b*. Shaft 98*a* is rotatably mounted within bearing 99*a* and extends through a bifurcated end 91 of second link 90. Spring friction disks or Belleville springs 99 are disposed between the bifurcated end 91 of the second link 90 and the parallel links 84, 86 to act as a brake to prevent the followers 98 from moving in the cam slots 96 during the dwell portion of the ram. Third link 100 is connected at one end to the bifurcated end 91 and is connected at the other end to crankshaft 102 for driving the output shaft 104. The output shaft 104 is rotatably mounted in bearing housing 106 by bearings 106*a* (FIG. 11).

A preferred form of the finger drive 41 is seen in FIGS. 18–20 where identical numerals will be used for identical parts. In this embodiment, the parallel links 46, 48 are guided within the cam plates 64 by guide rollers 110 rotatably mounted to extend inwardly of the cam plate 64. The guide rollers 110 engage along an outer surface of the parallel links 46, 48 for guided reciprocal movement. The guide rollers 110 are secured to the cam plates 64 by any means 111 such as screws and are removable to allow assembly and disassembly. The second link 112 has a substantially S-shaped slot 113 that receives the follower 50 interconnecting the ends of the parallel links 46, 48. The second link has first and second cam followers 114, 116. The second cam followers 116 are rotatably mounted at one end of the second link 112 and engage along an outer cam surface 64*a* of the cam plates 64. The cam followers 116 are connected to the second link 112 at a bifurcated end 117. The cam plates 64 have an arcuate slot 115 to receive the cam followers 116 when the second link 112 is in the lowermost position. The other end of the second link has cam followers 114 received within cam slots 66 in the cam plates 64. The other end of the second link 112 is bifurcated at 117' for connection with third link 58 similar to the embodiment of FIG. 3. This construction of the finger drive allows for a shorter second link 112 to be used while obtaining the same length of travel of the parallel links 46, 48 as before. The overload mechanism 35 has spring loaded shouldered plungers 118 having the same function as the spring loaded balls of the embodiment of FIG. 3.

It is to be understood that a preferred embodiment of the transfer drive also utilizes the guide rollers 110 and a second link 112 having a substantially S-shaped slot for ease of assembly and disassembly and for conserving space.

A preferred embodiment of the drive plate 119 is shown in FIGS. 19–21 with the finger drive 41 to drive the fingers in an in/out motion. However, it is understood that the same drive plate is used on the transfer drive 76 to advance the carriage. The drive plate 119 is driven through a Scotch-yoke where the cam follower 70 of the crank arm 68 is received in cam slot 120 in a lower extension 121 of the drive plate 119. The upper portion 122 of the drive plate is substantially rectangular and is supported on the side of the housing by a grooved suspension plate 123. The suspension plate 123 is secured to the housing by any means such as screws 124 that connect the suspension plate 123 to a spacer 125. The drive plate 119 has means 126 for connecting to either of the fingers or the carriage, depending on which drive the drive plate 119 is used with. It can be seen from FIG. 21, as the crank shaft 68 rotates through a circular motion M by the output shaft 62, cam follower 70 transmits reciprocal motion to the drive plate 119 by the engagement with the cam slot 120 therein. Thus, it can be understood that the drive plate 119 transmits reciprocal motion to either of the fingers or the carriage.

FIG. 10 illustrates the motion of the drive as the ram moves from its bottom position shown in solid lines to the top position shown in phantom. FIGS. 12 and 13 illustrate the transfer drive when the ram is in the bottom position in which the followers 98 are positioned at the bottom of the cam slots 96. FIG. 14 illustrates the position in which the ram is in the top position where followers 98 are at the top of the cam slots 96.

As most seen clearly in FIG. 10, similar to the finger drive the transfer drive rotates the output shaft 104 only when cam followers 98 move within cam slots 96. Thus, as the ram moves upwardly from the solid line position in FIG. 10, the second link 90 is raised from its lowermost position by engagement of the follower member 88 in slot 92. The second link 90 rotates about cam followers 98 relative to the third link 100. This free travel movement of the ram 44 does not result in any driving engagement being transmitted to output shaft 104. Upon continued upward movement of the ram 82, the second link 90 is further moved upwardly to raise cam followers 98 along cam slots 96 from the lowermost position to the uppermost position. This movement of the cam followers 98 transmits movement to the third link 100 from the position shown in phantom in FIG. 10 to the position as shown in FIG. 12 to drive the output shaft about the desired angle of rotation. Then, as the ram begins to descend, there is again free travel of the ram 44 and the parallel links 84, 86 until cam followers 98 begin movement in cam slots 96.

It can be understood that the free travel movement in the finger drive 41 occurs at a different time than the free travel movement of the transfer drive 76. The timing of the finger drive 41 and the transfer drive 76 can be seen in the diagrams of FIGS. 15–17. In FIG. 15, A represents the position of the press ram at top dead center and B represents the beginning of the finger movement outward. At C, the fingers have moved completely outward so that the movement between B and C represents movement of the second cam followers 56 in the cam slots 66. Bottom dead center of the press ram is represented at D. At this position the links are in the position shown in FIG. 6 with the second cam followers 56 being located at the bottom of the cam slots 66. The movement from D to E represents movement of the links from the bottom dead center position as seen in FIG. 6 to a point (not shown) where second cam followers 56 begin movement of travel within cam slots 66. The movement of the links from the position of FIG. 6 to the position of FIG. 8 is represented by E and F, with F representing the point where the fingers are moved completely inward. The movement from point F back to A represents free travel of the ram to top dead center.

FIG. 16 represents timing of the transfer drive where movement from A to C represents free travel of the ram from the upper most position seen in phantom of FIG. 10 to a position (not shown) to where the cam followers 98 start to move within cam slots 96. The movement of the cam followers 98 from the upper most position to a lower most position within the cam slots 96 is represented by points C and D, respectively resulting in transfer return movement. As the ram starts its upstroke, there is a free travel of the links to a point where the cam followers 98 again start movement in cam slots 96 and this free travel movement is represented between points D and F. The movement from F to A again represents movement of the cam followers 98 from the bottom of the cam slots 96 to the top thereof resulting in forward transfer movement.

The combination of finger drive movement and transfer movement is represented by the timing diagram of FIG. 17. It can be seen that during finger motion, the transfer drive is in the dwell mode.

I claim:

1. A drive for a transfer device having a reciprocating ram, the transfer device being driven by the ram and having a support, a carriage mounted on the support for movement along a path, work engaging fingers mounted on the carriage for movement in a path transverse to the path of movement of the carriage, such that as the ram reciprocates, the carriage and work engaging fingers transfer workpieces between successive stations, wherein the drive comprising a base, a housing supported on said base, a plurality of interconnecting links within said housing operably connected to the ram, cam means on one of said housing and one of said links, cam follower means on the other of said housing and one of said links, and an output shaft driven by said links and operably connected to one of the carriage and the work engaging fingers, said plurality of links comprising a first link connected to said ram means at one end and having follower means at the other end, a second link having a slot for receiving said follower means, said cam follower means comprising a first cam roller on said second link, and a third link connected at one end to said second link and to a crankshaft connected to said output shaft at the other end, such that as the ram reciprocates, the links pivot with respect to each other inside said housing causing said cam follower means to move along said cam means to rotate said output shaft 180°, such that the acceleration and deceleration of the transfer device is achieved.

2. The drive set forth in claim 1 wherein said cam means comprises a cam plate having a cam slot therein for receiving said first cam roller such that as said ram means reciprocates, said first cam roller means within said cam slot.

3. The drive set forth in claim 2 further comprising a crank arm connected to said output shaft, roller means at one end of said crank arm, a drive plate having a slot for receiving said roller means, and means connecting said drive plate to said carriage for reciprocal movement.

4. The drive set forth in claim 3 further comprising support means on the outside of said housing to support said drive plate.

5. The drive set forth in claim 2 further comprising cam roller on said second link, and a second cam roller on said second link, and an outer cam surface on said housing for engagement with said second cam roller such that as said ram means reciprocates, said second cam roller moves along said outer cam surface.

6. The drive set forth in claim 5 further comprising a crank arm connected to said output shaft, roller means at one end of said crank arm, a drive plate having a slot therein for receiving said roller means, and means connecting said drive plate to said work engaging fingers for reciprocal movement.

7. The drive set forth in claim 6 further comprising support means on the outside of said housing to support said drive plate.

8. The drive set forth in claim 1 wherein said slot is said second link is substantially S-shaped.

9. The drive set forth in claim 1 wherein said first link comprises parallel link members.

10. The drive set forth in claim 1 further comprising guide grooves on an inside surface of said cam plate to receive said first link for guided reciprocal movement.

11. The drive set forth in claim 1 further comprising guide roller means mounted within said housing for engaging an outer surface of said first link for guided reciprocal movement.

12. The drive set forth in claim 3 further comprising means to prevent movement of said first cam roller during a dwell portion of travel of said ram.

13. The drive set forth in claim 12 wherein said means comprises spring disk means.

14. A transfer device for indexing a work piece progressively through a plurality of stations, comprising a support, a carriage reciprocally mounted on said support along a path, work engaging fingers mounted on said carriage for reciprocal movement in a path transverse to the path of said carriage, a ram operable along a path transverse to the path of both said carriage and said work engaging fingers, drive means interconnecting said ram means and the transfer device for moving said carriage and said work engaging fingers, said drive means comprising a base, a housing supported on said base, a plurality of interconnecting links within said housing operably connected to the ram, cam means on one of said housing and one of said links, cam follower means on the other of said housing and said one of said links, and an output shaft driven by said links and operably connected to one of the carriage and the work engaging fingers such that as the ram reciprocates, the links pivot with respect to each other inside said housing causing said cam follower means to move along said cam means to rotate said output shaft 180°, such that the desired acceleration and deceleration of the transfer device is achieved, said drive means comprising a base, a housing supported on said base, a plurality of links within said housing operably connected to said ram means, cam means on said housing, cam follower means on one of said parallel links for engagement with said cam means, an output shaft operably connected to one of said links, means on said output shaft for driving engagement with one of said carriage and said work engaging fingers to reciprocate either said carriage or said work engaging fingers.

15. The transfer device set forth in claim 14 wherein said plurality of links comprise, a first link connected to said ram means at one end and having follower means at the other end, a second link having a slot for receiving said follower means, said cam follower means comprising a first cam roller on said second link, and a third link connected at one end to said second link and to a crankshaft connected to said output shaft at the other end.

16. The transfer device set forth in claim 15 wherein said cam means comprises a cam plate having a cam slot therein for receiving said first cam roller such that as said ram means reciprocates, said first cam roller moves within said cam slot.

17. The transfer device set forth in claim 16 further comprising a crank arm connected to said output shaft, roller means at one end of said crank arm, a drive plate having a slot for receiving said roller means, and means connecting said drive plate to said carriage for reciprocal movement.

18. The transfer device set forth in claim 17 further comprising support means on the outside of said housing to support said drive plate.

19. The transfer device set forth in claim 18 further comprising a second cam roller on said second link, and an outer cam surface on said housing for engagement with said second cam roller such that as said ram means reciprocates, said second cam roller moves along said outer cam surface.

20. The transfer device set forth in claim 16 further comprising a crank arm connected to said output shaft, roller means at one end of said crank arm, a drive plate having a slot therein for receiving said roller means, and means connecting said drive plate to said work engaging fingers for reciprocal movement.

21. The transfer device set forth in claim 20 further comprising support means on the outside of said housing to support said drive plate.

22. The transfer device set forth in claim 21 wherein said slot in said second link is substantially S-shaped.

23. The transfer device set forth in claim 22 wherein said first link comprises parallel link members.

24. The transfer device set forth in claim 15 further comprising guide grooves on an inside surface of said cam plates to receive said first link for guided reciprocal movement.

25. The transfer device set forth in claim 15 further comprising guide roller means mounted within said housing for engaging an outer surface of said first link for guided reciprocal movement.

26. The transfer device set forth in claim 17 further comprising means to prevent movement of said first cam roller during a dwell portion of travel of said ram.

27. The transfer device set forth in claim 26 wherein said means comprises spring disk means.

* * * * *